United States Patent [19]

Davis

[11] Patent Number: 4,958,540

[45] Date of Patent: Sep. 25, 1990

[54] IMPACT TOOL HANDLE

[76] Inventor: Curtis E. Davis, 1462 Tamassee Dr., Seneca, S.C. 29678

[21] Appl. No.: 411,997

[22] Filed: Sep. 25, 1989

[51] Int. Cl.[5] ..... B25D 1/04; B25G 1/10

[52] U.S. Cl. ..... 81/20

[58] Field of Search ..... 173/170; 81/20–27; 16/110 R

[56] References Cited

U.S. PATENT DOCUMENTS

| | | | |
|---|---|---|---|
| 50,262 | 10/1865 | Monson | 81/20 |
| 2,919,613 | 1/1960 | Crement | 81/20 |
| 3,100,120 | 8/1963 | Cleary | 16/110 R |

FOREIGN PATENT DOCUMENTS

| | | | |
|---|---|---|---|
| 232168 | 3/1911 | Fed. Rep. of Germany | 81/20 |
| 2048752 | 12/1980 | United Kingdom | 81/20 |

*Primary Examiner*—Hien H. Phan
*Assistant Examiner*—Scott A. Smith
*Attorney, Agent, or Firm*—Cort Flint

[57] ABSTRACT

An impact tool (A) is disclosed which includes an arrangement of angularly disposed shanks which provide a mechanical advantage to the impact force. A first shank (10) provides a grip (12) held generally orthogonal by hand (14) of the user. A second shank (16) extends generally in a straight line to the arm (24) when the grip is held in the hand, and a third shank (18) extends from the second shank (16) at an angle and terminating in an impact head (20). The device thrusts generally forward with the arm and shoulder during impact with little or no wrist movement as encountered in the sense of a conventional handle. Control is afforded by the angle arrangement of the handle as well as increased force.

8 Claims, 1 Drawing Sheet

IMPACT TOOL HANDLE

BACKGROUND OF THE INVENTION

The invention relates to an impact tool such as a hammer, ax, or the like, more particularly to a handle for such a tool which increases the force achieved by the tool without a significant increase of energy.

The conventional hammer is composed of a hammer head which is fixed at right angles to a handle parallel to the planar working surface. The user employs his shoulder, full arm, and wrist working together to impart a force upon impact of the hammer head. At the moment of impact, it is said that the user's hand does not take full advantage of the potential wrist movement due to the configuration of the handle. U.S. Pat. No. 4,363,344 discloses a hammer having a handle with proximal and distal portions, neither of which is parallel to the planar working surface of the hammer head. This is said to take fuller advantage of potential wrist movement, and provide greater control of the working movement of the hammer head. The handle includes two handle portions disposed at an angle. The patented construction and arrangement seeks to increase the potential in the wrist movement for driving a nail. However, the potential in the wrist movement is limited. As in the case of a conventional hammer, driving a nail achieved by wrist movement is not highly accurate or effective in force attenuation. Moreover, the muscles involved in using wrist movement are highly susceptible to fatigue. The use of a conventional hammer typically requires that the user is positioned close into the work in order to enforce impact with the wrist. The hammer can easily twist in a roll motion resulting in an inaccurate impact.

Accordingly, an object of the invention is to provide a handle for an impact tool which primarily uses the power from the arm and shoulder in place of wrist action.

Another object of the invention is to provide a handle for an impact tool such as a hammer and the like which reduces damage to the wrist by reducing the need for primary power associated with wrist movement.

Another object of the invention is to provide a handle for an impact tool which allows a more firm grip and accuracy in striking in a given direction.

Another object of the invention is to provide an handle for an impact tool which does not require excessive wrist movement, has a good feel and grip at a normal angle of hand grip for enhanced lateral control and reduction in twisting motion.

Yet another object of the invention is to provide an impact tool having all of the aforementioned advantages which also protects the fingers and knuckles from impact while striking.

SUMMARY OF THE INVENTION

The above objectives are accomplished according to the present invention by providing a handle for an impact tool which includes three shanks angularly disposed. A first shank includes a grip held by the hand normal to the arm. A second shank extends at a prescribed angle from the first shank, and a third shank extends between the second shank and the impact head. Preferably, the first and second shanks are disposed at an angle between 75 and 90 degrees to each other, and the third and second shanks are disposed at an angle between 40 to 55 degrees. These are preferable characteristics where the handle is used for a hammer head.

The second shank is carried generally along the same line as the arm so that the full force of the arm as it swings forward is imparted to the hammer head. Little or no wrist action is involved once the wrist is cocked in a desired position with most of the force coming from the shoulder and arm.

DESCRIPTION OF THE DRAWINGS

The construction designed to carry out the invention will hereinafter be described, together with other features thereof. The invention will be more readily understood from a reading of the following specification and by reference to the accompanying forming a part thereof, wherein an example of the is shown and wherein.

DESCRIPTION OF A PREFERRED EMBODIMENT

Figure 1:
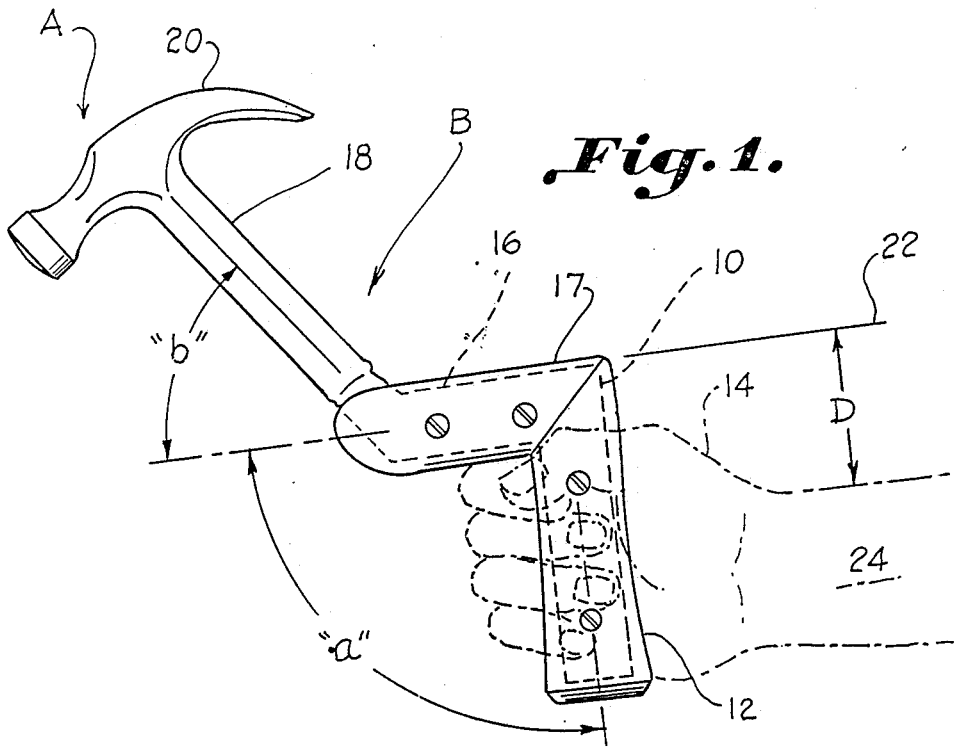
FIG. 1 is a side elevation of an impact handle and tool constructed according to the invention in a normal hand grip position.

Referring now in more detail to the drawings, an impact tool designated generally as A is illustrated having a handle designated generally at B which provides a mechanical advantage to the impact of the tool through an arrangement of mechanical leverage achieved by arrangement of a plurality of shanks disposed angularly in the handle. There is a first shank 10 having grip 12 which may be comfortably gripped by a hand 14 of the user. A second shank 16 extends at an angle "a" from first shank 10. A third shank 18 extends at an angle "b" from shank 16 and terminates in a hammer head 20 mounted orthogonal to shank 18. While a hammer head is illustrated in a preferred embodiment, it is to be understood that handle B may be advantageously utilized for other impact tools as well. As illustrated, shanks 10 and 16 are covered by handle portions 12 and 17, respectively. Shanks 10, 16, 18 may be cast as one piece, may be made integral by welding, or may be attached together by adjustable means so as to vary the relative angular dispositions. However, in the preferred embodiment of FIGS. 1 and 2, the shanks are made as one piece in a standard hammer configuration which would have a wide range of applicability for carpenter, construction work, and the like. It is to be understood, of course, that the impact handle and head may also be made without handle covers 12 and 17. In this case, the shanks may be made to function also as handles.

Figure 2:
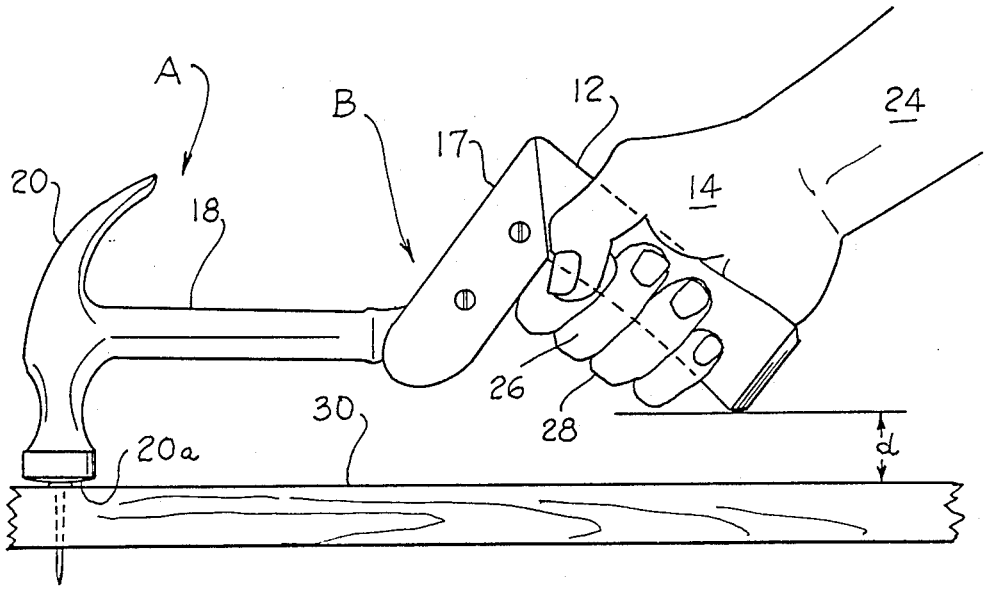
FIG. 2 a side elevation of an impact handle and tool constructed according to the invention in an impact position.

As can best be seen in FIG. 1, shanks 10 and 16 are at angle "a" in a range of about 75 to 90 degrees with respect to each other, with 90 degrees being preferred. The angle "b" of shank 18, 16 is in a range of about 40 to 55 degrees with 45 degrees being preferred. In a preferred embodiment, angle "a" is about 90 degrees and angle "b" is about 45 degrees. In this arrangement, shank 16 lies generally along a line 22 spaced a distance "D" from an arm 24 of the user. Line 22 and the effective axis of arm 24 are generally parallel. In this manner, the hammer moves forward along the line in which the arm moves for multiplication of the mechanical advantage. In use, the impact handle is grasped by hand 14 in an almost normal position, as can best be seen in FIG. 1. Upon impact, the wrist is cocked slightly, as can best be seen in FIG. 2. However, the force upon impact is made with only slight wrist movement and with the main thrust of the force coming from the forward thrust of the arm and shoulder movement. This results in a mechanical advantage achieved through the leverage and shank arrangement of the handle. Further, because of the shank arrangement of the handle, lateral twisting of the impact handle and head in the hand is considerably reduced over that of a conventional hammer. This means that not only is the impact made with a larger force, but more accurately, all of which result in a more efficient driving of a nail or other object on impact. Upon impact, it can be seen that the fingers 26 and knuckles 28 of the user are spaced a distance "d" above the planar impact surface 30. The impact head 20*a* of hammer head 20 strikes planar surface 30 with the fingers and knuckles adequately spaced above the planar surface in the normal striking pattern.

In practice, the handle shanks may be made from a metal or other structurally adequate material, the handle portions 12 and 16 may be made from wood, fiberglass, plastic, vinyl, or other suitable materials. The weight of the tool, length of the handle, and type of impact head can be varied depending upon the application being made.

Thus, it can be seen that an advantageous construction can be had for an impact tool according to the invention which provides increased mechanical advantage, and has a comfortable feel and grasp. The tool is used with the arm in a more normal outstretched position for impact. With the tool grasped by the handle, it is about normal to the arm in a most natural position and thrusts generally forward in a straight line with the arm and the tool being only slight cocked for impact. As cocked in the hand, the angular handle arrangement cannot twist or turn as easily as a conventional hammer so that it accurately impacts the object on the forward impact stroke. Wrist popping and movement is reduced that often leads to damage of more susceptible wrist parts of the body. A better angle of attack is had through the handle arrangement and better control over the lateral movement.

While a preferred embodiment of the invention has been described using specific terms, such description is for illustrative purposes only, and it is to be understood that changes and variations may be made without departing from the spirit or scope of the following claims.

What is claimed is:

1. An impact tool having an impact handle and an impact head wherein said impact handle comprises:

a first shank which provides a grip for said handle;

a second shank extending from said first shank which is integrally connected to said first shank;

a first angle between said first and second shanks;

a third shank extending from said second shank which is integral with said second shank;

a second angle between said second and third shanks;

an elongated impact body carried by said third shank extending transverse to said third shank; and said impact head carried at a free end of said impact body said impact head having an impact surface lying in a plane substantially parallel to a longitudinal axis of said third shank.

2. The device of claim 1 wherein said first angle is in a range of about 75 to 90 degrees.

3. The device of claim 2 wherein said first angle is about 90 degrees.

4. The device of claim 1 wherein said second angle is in a range of about 40 to 55 degrees.

5. The device of claim 4 wherein said second angle is about 45 degrees.

6. The device of claim 1 wherein said first angle is in the range of about 75 to 90 degrees and said second angle is in a range of about 40 to 55 degrees.

7. The device of claim 1 wherein said first angle is about 90 degrees and said second angle is about 45 degrees.

8. The device of claim 1 including a handle grip carried by said first shank for being held by a hand of a user generally at a right angle to a forearm of said user; and said second shank extending from said handle grip having a longitudinal axis lying generally along the line of said forearm of said user when said handle grip is held generally normal by said hand.

* * * * *